United States Patent [19]

Boyd

[11] Patent Number: 4,979,659

[45] Date of Patent: Dec. 25, 1990

[54] AIR BOTTLE SUPPORT HARNESS

[76] Inventor: Kenneth B. Boyd, 6929 E. Cherry Grove Ave., Las Vegas, Nev. 89115

[21] Appl. No.: 476,975

[22] Filed: Feb. 7, 1990

[51] Int. Cl.[5] ..... A45F 3/14

[52] U.S. Cl. ..... 224/205; 224/258; 128/205.22

[58] Field of Search ..... 224/257, 258, 202, 205, 224/250, 148, 901; 294/137, 149, 150, 31.2, 157, 154; 248/313; 128/205.22, 201.27; 220/85 H; 222/175; 239/152; 2/310, 323

[56] References Cited

U.S. PATENT DOCUMENTS

| | | | |
|---|---|---|---|
| 1,592,556 | 7/1926 | Canaan, Jr. | 224/205 |
| 2,298,694 | 6/1942 | Haislip | 224/205 |
| 2,884,173 | 4/1959 | Campbell et al. | 224/5 |
| 4,220,302 | 9/1980 | Hampton et al. | 224/901 |
| 4,261,494 | 4/1981 | Thomas | 224/205 |
| 4,310,110 | 1/1982 | Dexter | 224/246 |
| 4,377,163 | 3/1983 | Feathers | 128/205.22 |
| 4,385,528 | 5/1983 | Eppolito | 224/210 |
| 4,420,104 | 12/1983 | DiIenno | 224/250 |
| 4,438,764 | 3/1984 | Eppolito | 128/205 |
| 4,586,687 | 5/1986 | Ziaylck | 248/313 |
| 4,685,456 | 8/1987 | Smart | 128/205.22 |
| 4,688,643 | 8/1987 | Carter et al. | 169/33 |
| 4,796,936 | 1/1989 | Sherin | 294/31.2 |
| 4,819,845 | 4/1989 | Byrd | 224/204 |

FOREIGN PATENT DOCUMENTS

| | | | |
|---|---|---|---|
| 856099 | 3/1940 | France | 128/205.22 |
| 2615078 | 11/1988 | France | 224/148 |
| 10492 | 7/1895 | Switzerland | 128/205.22 |

*Primary Examiner*—Henry J. Recla
*Assistant Examiner*—Glenn T. Barrett
*Attorney, Agent, or Firm*—Quirk, Tratos & Roethel

[57] ABSTRACT

An air bottle support harness for hand-free carrying a compressed air bottle. The harness includes an arm sling with laterally extending spaced retention loops adapted to encircle the bottle to hold the same on the support harness when the arm sling is supported on a shoulder of the wearer.

1 Claim, 2 Drawing Sheets

AIR BOTTLE SUPPORT HARNESS

This invention relates to an air bottle support harness to enable a firefighter to hand-free carry a spare compressed air bottle into a smoke filled area in addition to air bottles or other equipment carried on a backpack.

BACKGROUND OF THE INVENTION

Fires in multi-storied office buildings, stores and apartment houses present a major problem in that the firefighter must carry a supply of compressed air in compressed air bottles carried on a backpack. In addition to the backpack supply, it frequently becomes necessary for the firefighter to hand carry a spare air bottle to increase the time that can be spent in the confines of the smoke filled building before a return to a smoke free atmosphere becomes necessary.

Compressed air bottles are now available that weigh about 15–20 pounds when filled which is substantially less than the old style containers that weigh about 30–35 pounds when filled. However, even a twenty pound air bottle can become quite burdensome as the firefighter in full firefighting garb climbs the stairs of a multi-story building. The weight of a hand carried air bottle can cause hand and shoulder fatigue. The fatigued firefighter could stumble on a stair step and in attempting to regain his balance drop the air bottle endangering anyone below him. A hand carried spare air bottle would limit the firefighters ability to carry hand tools, to operate communications equipment or to assist in rescue operations.

Accordingly, it is an object of the present invention to provide a shoulder harness equipped to hold a spare compressed air bottle to be carried by a firefighter.

It is a further object to provide a shoulder harness that will efficiently support a spare air bottle while leaving the hand of the firefighter free to grasp a hand rail as he gropes his way up a darkened smoke filled stairway.

It is a further object to provide a shoulder harness that will increase the efficiency of a firefight by leaving a hand that would otherwise be occupied with carrying an air bottle available to carry tools, operate communications equipment or to assist in rescue operations.

It is yet a further object of the present invention to provide a spare air bottle support harness that will enhance the firefighter's safety, comfort and endurance by relieving him of possible hand and shoulder fatigue from having to hand carry the spare.

These and other objects of the invention will be apparent from the following disclosure of a preferred embodiment of the present invention.

SUMMARY OF THE INVENTION

An air bottle support harness comprises an elongated strap having at one end a strap buckle for receiving the other end of the strap to form an arm sling. A pair of laterally extending spaced air bottle retention loops adapted to encircle an air bottle are secured to the elongated strap intermediate its ends. One of the retention loops has short depending strap elements coupled together to form a pocket to hold the lower end of the air bottle against displacement from the arm sling. The other retention loop has releasably overlapping sections facilitating attachment and removal of the air bottle to and from the arm sling.

BRIEF DESCRIPTION OF THE DRAWINGS

The invention is best understood with reference to the drawings, in which.

DETAILED DESCRIPTION OF THE INVENTION

Figure 1:
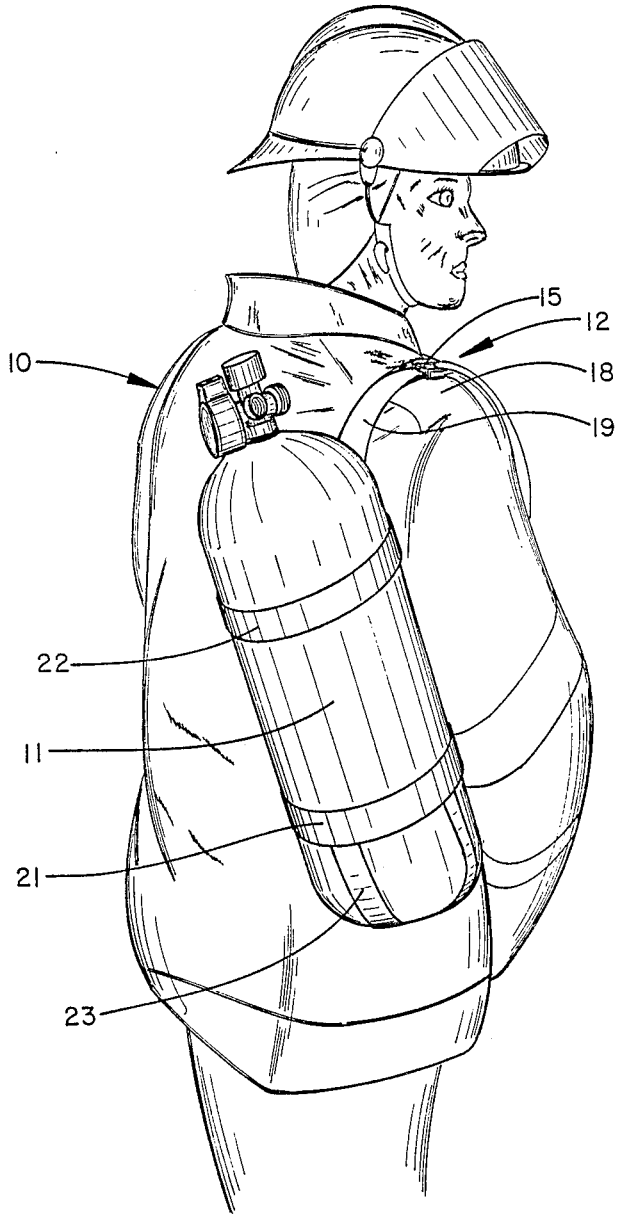
FIG. 1 is a rear perspective view of a firefighter wearing an air bottle support harness embodying the present invention.

Referring now to FIG. 1, a firefighter 10 is shown carrying a compressed air bottle 11. Frequently, when fighting fires in buildings in which the combustibles create a dense smoke, a firefighter may be ordered to hand-carry a spare air bottle up several flights of stairs. Air bottles are, however, are heavy, bulky and awkward to handle. The higher up the firefighter has to go, the more difficult the task becomes. The firefighter may begin to suffer hand and shoulder fatigue and may even lose his grip on the spare bottle with dire consequences to those below him on the staircase.

The firefighter 10 shown in FIG. 1, however, is shown equipped to carry a spare air bottle in hand-free manner by making use of a shoulder harness, generally designated 12, embodying the present invention. The use of the shoulder harness avoids the problems that might result from trying to hand carry the spare air bottle.

Figure 3:
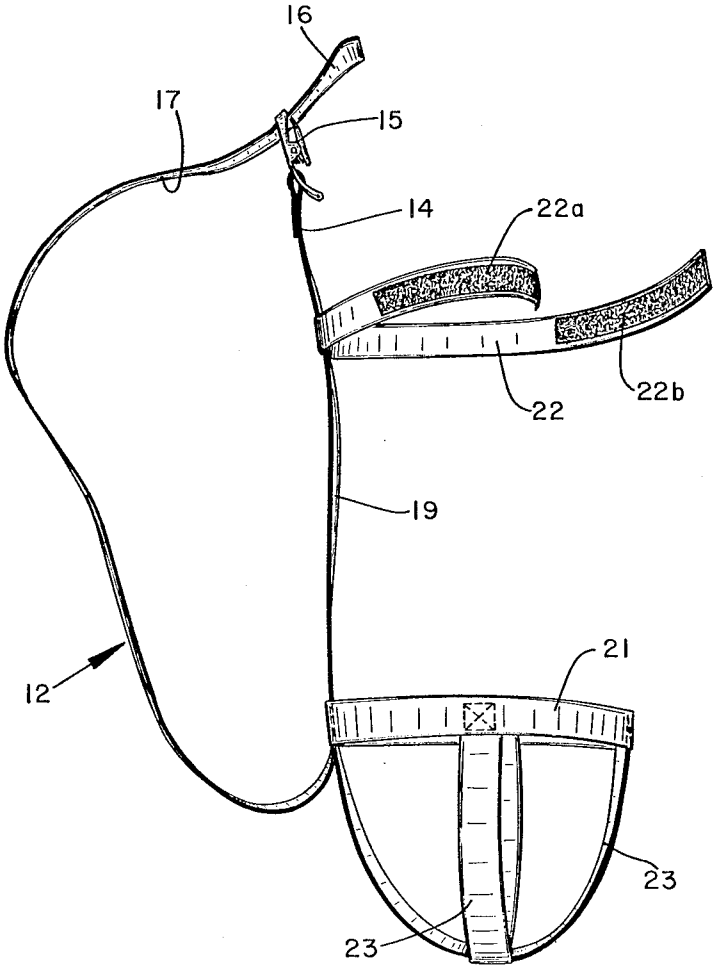
FIG. 3 is a side elevation of the shoulder harness prior to being strapped about the air bottle.
Figure 2:
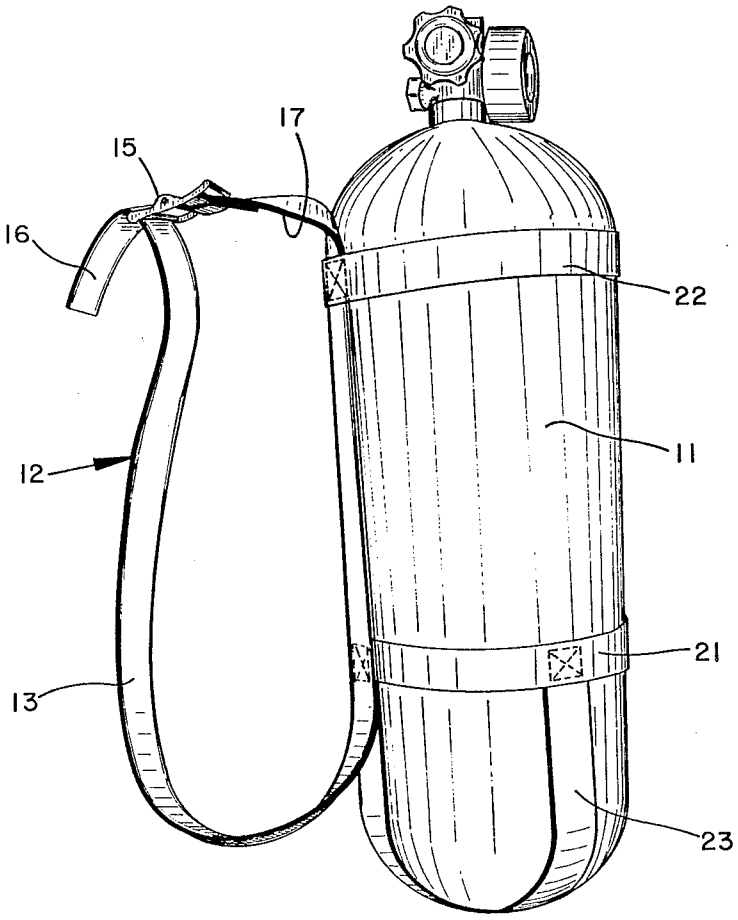
FIG. 2 is a side elevation of the shoulder harness strapped to an air bottle.

The shoulder harness 12 comprises an elongated strap 13, most clearly seen in FIG. 3. In the preferred embodiment a strap 13 approximately 40 inches in length was found to provide a shoulder harness that would accommodate most firefighters. The strap 13 at one end 14 has a strap buckle 15 adapted to receive the other or tongue end 16 of the strap 13 thereby to form an arm sling 17 adapted to fit the shoulder 18 of the firefighter. In the preferred embodiment, the strap buckle 15 is adjustable to a wide range of sizes to accommodate the varied physical characteristics of the firefighters.

When worn by a firefighter the arm sling has a downwardly extending backside segment 19 that lies between the firefighter's body and the wall of the air bottle. The segment 19 intermediate its ends has a pair of rearwardly, laterally extending retention loops, a lower loop 21 and an upper loop 22, each of which is adapted to encircle the air bottle. Each retention loop 21 and 22 is secured at one of its sides to the backside segment of the arm sling. The lower retention loop 21 has depending crisscrossed strap portions 23 that form a pocket in which the air bottle is seated and supported against downward vertical displacement from the shoulder harness 13.

The upper retention loop 22 has releasably overlapping sections **22*a* and 22*b* adapted to adjustably encircle the air bottle to hold the same close to the firefighter's shoulder. The releasably overlapping sections 22*a* and 22*b* have quick release fasteners such as Velcro type hooks and loops which permit quick connection to retain the air bottle within the upper retention loop 22 and quick disconnection when it is desired to remove the air bottle from the shoulder harness 13**. Alternatively, in lieu of the Velcro fasteners other fastening means such as a strap or cinch buckle may be used.

The components of the illustrated embodiment of the shoulder harness 12 are fabricated of water and mildew resistant canvas. The canvas material is preferably approximately 1 inch wide.

Although FIG. 1 of the drawings shows only a single support harness over a shoulder 18 of firefighter 10, it will be readily apparent that a similar support harness 12 could be fitted over the firefighter's other shoulder to allow two air bottles to be carried at the same time. The ability to transport spare bottles as enhanced by the air bottle support harness 12 embodying the present invention has a number of advantages. For example, the fire ground commander is able to fulfill an important tactical priority of assuring an adequate supply of breathing air. This is equally important in both high rise fires and incidents where long distances must be travelled from a staging area to an operations area.

The ease of removal of the air bottles from the shoulder harness allows a quicker "turn around" of the bottles. Teams delivering full bottles can collect empties to be transported to refill stations and returned to service. This eliminates loss or damage to valuable cylinders.

The air bottles may be stored in the harness 12 in a "ready to go" condition and in emergency procedures regulators can be attached directly to the air bottles while still in the harness thus eliminating time consuming switching operations.

While the invention has been illustrated with respect to a specific embodiment thereof, this embodiment should be considered illustrative rather than limiting. Various modifications and additions may be made and will be apparent to those skilled in the art. Accordingly, the invention should not be limited by the foregoing description, but rather should be defined only by the following claims:

I claim:

1. A shoulder harness to enable a firefighter to hand-free carry a spare compressed air bottle, comprising:

an elongated strap having at a first end a strap buckle for receiving a second end of the strap having a buckle engageable portion thereon, the strap when the ends are buckled together forming a continuous loop arm sling adapted to hang from a shoulder of the firefighter, the arm sling when worn by the firefighter having a backside segment extending down the firefighter's back, a non adjustable lower loop and an adjustable upper loop vertically spaced from each other and extending rearwardly and laterally of said elongated strap, each loop being attached at one of its sides to the backside segment of said sling at one point, the lower retention loop having depending criss-crossed strap portions connected thereto forming a support to hold the air bottle against vertical downward displacement from the shoulder harness, and the upper retention loop having releasably overlapping sections opposite its attachment to the strap segment for adjustability, the overlapping sections having quick release fasteners to facilitate insertion or removal of the air bottle from the shoulder harness.

* * * * *